US009440450B2

(12) United States Patent
Shintani et al.

(10) Patent No.: US 9,440,450 B2
(45) Date of Patent: Sep. 13, 2016

(54) THERMAL HEAD AND THERMAL PRINTER PROVIDED WITH SAME

(71) Applicant: KYOCERA Corporation, Kyoto-shi, Kyoto (JP)

(72) Inventors: Shigetaka Shintani, Kyoto (JP); Masashi Yoneta, Kyoto (JP)

(73) Assignee: KYOCERA CORPORATION, Kyoto-Shi, Kyoto (JP)

( * ) Notice: Subject to any disclaimer, the term of this patent is extended or adjusted under 35 U.S.C. 154(b) by 0 days.

(21) Appl. No.: 14/426,778

(22) PCT Filed: Sep. 30, 2013

(86) PCT No.: PCT/JP2013/076561

§ 371 (c)(1),
(2) Date: Mar. 9, 2015

(87) PCT Pub. No.: WO2014/051143

PCT Pub. Date: Apr. 3, 2014

(65) Prior Publication Data

US 2015/0298463 A1 Oct. 22, 2015

(30) Foreign Application Priority Data

Sep. 28, 2012 (JP) ..... 2012-217055

(51) Int. Cl.
*B41J 2/335* (2006.01)

(52) U.S. Cl.
CPC ..... *B41J 2/3351* (2013.01); *B41J 2/3353* (2013.01); *B41J 2/3354* (2013.01); *B41J 2/3357* (2013.01); *B41J 2/33515* (2013.01); *B41J 2/33545* (2013.01)

(58) Field of Classification Search
CPC ..... B41J 2/32; B41J 2/335; B41J 2/33515; B41J 2/33525; B41J 2/3353; B41J 2/33535
See application file for complete search history.

(56) References Cited

U.S. PATENT DOCUMENTS 5,099,257 A 3/1992 Nakazawa et al.
2010/0085412 A1* 4/2010 Kanei ..... B41J 2/33515 347/203

FOREIGN PATENT DOCUMENTS

CN 101636275 A 1/2010
JP 120382/1982 U 2/1984

(Continued)

OTHER PUBLICATIONS

International Search Report, PCT/JP2013/076561, Date of Mailing: Dec. 17, 2013, 2 pgs.

(Continued)

*Primary Examiner* — Geoffrey Mruk
(74) *Attorney, Agent, or Firm* — Volpe and Koenig, P.C.

(57) ABSTRACT

A thermal head which is capable of reducing heat concentration on heat generation portions, and a thermal printer provided with the thermal head are provided. A thermal head includes a substrate; a plurality of heat generation portions which are disposed aligned on the substrate; electrodes which are electrically connected to the heat generation portions; and a protection layer which coats the heat generation portions and a part of the respective electrodes. The protection layer includes a first protection layer which is disposed on the heat generation portions and a second protection layer which is disposed on the first protection layer and has a higher thermal conductivity than that of the first protection layer. A width of the second protection layer is larger than that of the first protection layer when seen in an arrangement direction of the heat generation portions.

20 Claims, 8 Drawing Sheets

(56) References Cited

FOREIGN PATENT DOCUMENTS

| | | | |
|---|---|---|---|
| JP | 62-062775 | A | 3/1987 |
| JP | 63-81062 | A | 4/1988 |
| JP | 3-193363 | A | 8/1991 |
| JP | 3-275365 | A | 12/1991 |
| JP | 4-110166 | A | 4/1992 |
| JP | 6-79896 | A | 3/1994 |
| JP | 2002-178549 | A | 6/2002 |

OTHER PUBLICATIONS

Chinese Office Action with English concise explanation, Chinese Patent Application No. 201380046800.0, Apr. 18, 2016, 7 pgs.

* cited by examiner (a)

(b)

(a)

(b)

(a)

(b)

(a)

(b)

THERMAL HEAD AND THERMAL PRINTER PROVIDED WITH SAME

TECHNICAL FIELD

The present invention relates to a thermal head and a thermal printer provided with the same.

BACKGROUND ART

In the related art, various thermal heads have been proposed as a printing device for a facsimile, a video printer or the like. For example, a thermal head including a substrate, a plurality of heat generation portions which are disposed aligned on the substrate, electrodes which are electrically connected to the heat generation portions, and a protection layer which covers the heat generation portions and a part of the respective electrodes, is known (for example, see Patent Literature 1). In addition, a protection layer including a first protection layer which is disposed on the heat generation portions, and a second protection layer which is disposed on the first protection layer and has a lower thermal conductivity than that of the first protection layer, is known (for example, see Patent Literature 1).

CITATION LIST

Patent Literature

Patent Literature 1: Japanese Unexamined Patent Publication JP-A 62-062775 (1987)

SUMMARY OF INVENTION

Technical Problem

However, in the thermal head, described above, the heat generated by the heat generation portions may be diffused to the first protection layer which is provided on the heat generation portions and has a high thermal conductivity, and accordingly, heat may be concentrated on the heat generation portions.

Solution to Problem

A thermal head according to one embodiment of the invention includes: a substrate; a plurality of heat generation portions which are disposed aligned on the substrate; electrodes which are electrically connected to the heat generation portions; and a protection layer which coats the heat generation portions and a part of the respective electrodes. In addition, the protection layer includes a first protection layer which is disposed on the heat generation portions and a second protection layer which is disposed on the first protection layer and has a higher thermal conductivity than that of the first protection layer. Further, a width of the second protection layer is larger than a width of the first protection layer when seen in a cross-sectional view in an arrangement direction of the heat generation portions.

Further, a thermal printer according to one embodiment of the invention includes: the thermal head mentioned above; a conveyance mechanism of conveying a recording medium onto the heat generation portions; and a platen roller which presses the recording medium against the heat generation portions.

Advantageous Effects of Invention

According to the invention, it is possible to efficiently diffuse the heat of the first protection layer to the second protection layer having a width larger than that of the first protection layer and it is possible to reduce the possibility of heat concentration occurring on the heat generation portions.

DESCRIPTION OF EMBODIMENTS

First Embodiment

Figure 1:
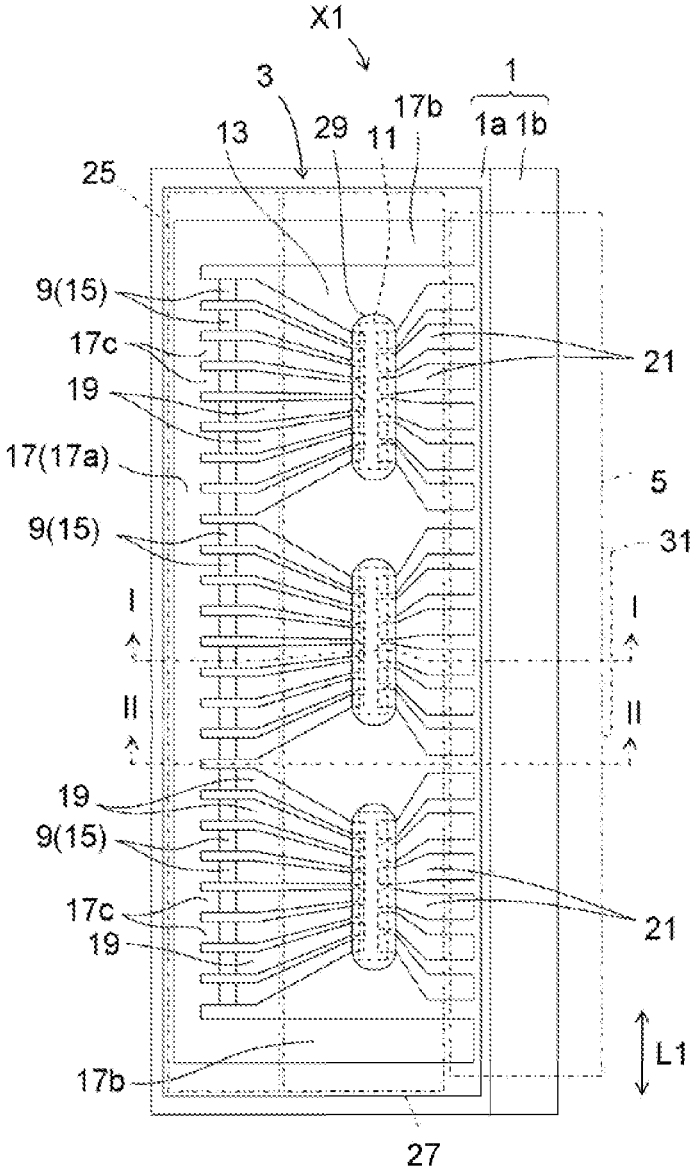
FIG. 1 is a plan view showing a thermal head according to one embodiment of the invention.
Figure 2:
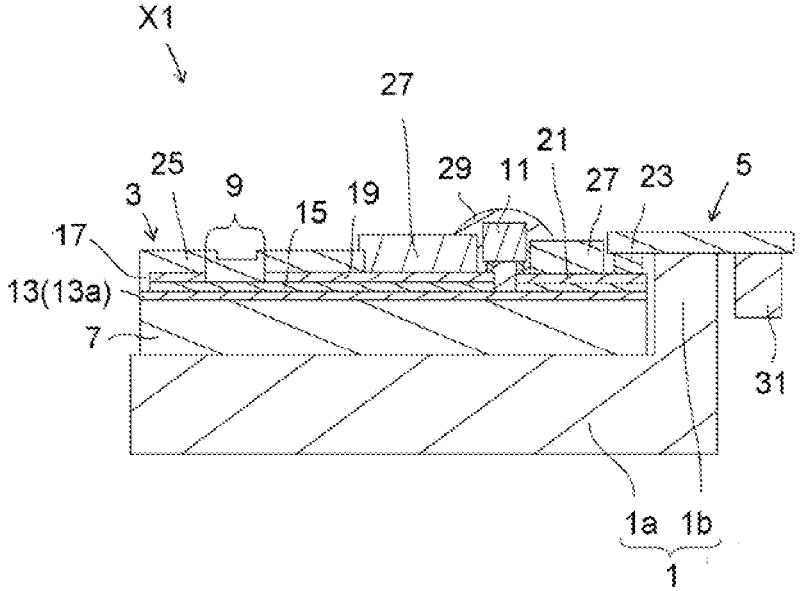
FIG. 2 is a cross-sectional view taken along the line I-I shown in FIG. 1.
Figure 3:
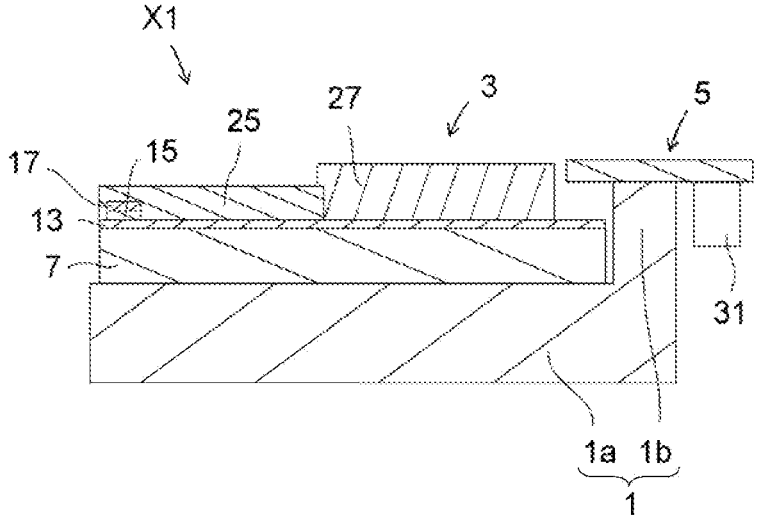
FIG. 3 is a cross-sectional view taken along the line II-II shown in FIG. 1.

Hereinafter, a thermal head X1 will be described with reference to FIGS. 1 to 4. The thermal head X1 includes a radiator 1, a head base body 3 which is disposed on the radiator 1, and a flexible printed circuit 5 (hereinafter, referred to as a FPC 5) connected to the head base body 3. In FIG. 1, representation of the FPC 5 is omitted and an region where the FPC 5 is disposed is shown with a dashed-dotted line. In FIGS. 1 to 3, the configuration of a protection layer 25 is simply shown.

The radiator 1 is formed, in a plate shape and has a rectangular shape when seen in a plan view. The radiator 1 includes a plate-shaped base portion 1*a* and a protrusion 1*b* which protrudes from the base portion 1*a*. The radiator 1 is, for example, formed of a metal material such as copper, iron, or aluminum, and has a function of radiating some heat not contributing to printing, of the heat generated in heat generation portions 9 of the head base body 3. In addition, the head base body 3 is bonded to an upper surface of the base portion 1*a* with double-sided tape or an adhesive (not shown).

The head base body 3 is formed in a plate shape when seen in a plan view, and members constituting the thermal head X1 are disposed on a substrate 7 of the head base body 3. The head base body 3 has a function of performing printing on a recording medium (not shown) according to an electrical signal supplied from the outside.

The FPC 5 is electrically connected to the head base body 3 and includes an insulating resin layer (not shown) and printed wires (not shown) patterned in the inside of the resin layer. The plurality of printed wires are provided. One end of the respective printed wires is exposed from the resin layer and the other end of the respective printed wires is electrically connected to a connector 31.

The printed wires of the FPC 5 are connected to connection electrodes 21 of the head base body 3 through a jointing material 23. Accordingly, the head base body 3 and the FPC 5 are electrically connected to each other. Examples of the jointing material 23 include a solder material or an anisotropic conductive film (ACF) obtained by mixing conductive particles in an electrical insulating resin.

In the thermal head X1, a reinforcing plate (not shown) formed of a phenol resin, a polyimide resin, or a glass epoxy resin may be disposed between the FPC 5 and the radiator 1. The reinforcing plate may be connected to the FPC 5 over an entirety of the FPC 5. The reinforcing plate is bonded to a lower surface of the FPC 5 with double-sided tape or an adhesive.

An example using the FPC 5 as a circuit board has been shown, but a hard circuit board may be used instead of using the FPC 5 having flexibility. As the hard circuit, board, a substrate formed of a resin such as a glass epoxy substrate or a polyimide substrate can be exemplified.

Hereinafter, members constituting the head, base body 3 will be described.

The substrate 7 is formed of an electrical insulating material such as alumina ceramics or a semiconductor material such as single crystal silicon.

A heat storage layer 13 is formed on the upper surface of the substrate 7. The heat storage layer 13 is formed, over the entire upper surface of the substrate 7 in ah approximately uniform manner with a thickness of 50 to 200 μm, for example. The heat storage layer 13 is formed of glass having low thermal conductivity and temporarily stores some of the heat generated in the heat generation portions 9. Accordingly, the heat storage layer 13 can shorten the time necessary for increasing the temperature of the heat generation portions 9 and increase thermal responsiveness of the thermal head X1.

The heat storage layer 13 is, for example, formed by applying glass paste on the upper surface of the substrate 7 by screen printing and firing the applied glass paste.

An electrical resistance layer 15 is provided on the upper surface of the heat storage layer 13 with a thickness of 200 to 1000 Å, for example. A common electrode 17, an individual electrode 19, and the connection electrode 21 are disposed on the electrical resistance layer 15. The electrical resistance layer 15 is patterned in the same shape as that of the common electrode 17, the individual electrode 19, and the connection electrode 21, and has exposed regions in which the electrical resistance layer 15 is exposed between the common electrode 17 and the individual electrode 19. As shown in FIG. 1, the exposed regions of the electrical resistance layer 15 are disposed in a line and each exposed region configures the heat generation portion 9. The plurality of the heat generation portions 9 are simply shown in FIG. 1, but the heat generation portions 9 are disposed at a density of 100 dpi (dot per inch) to 2400 dpi, for example.

The electrical resistance layer 15 is, for example, formed of a material having a high electrical resistance value such as a TaN-based, material, a TaSiO-based material, a TaSiNO-based material, a TiSiO-based material, a TiSiCO-based material, or a NbSiO-based material. Accordingly, when a voltage is applied, the heat generation portion 9 generates heat through joule heating.

As shown in FIGS. 1 and 2, the common electrode 17, the plurality of individual electrodes 19, and the plurality of connection electrodes 21 are disposed on the upper surface of the electrical resistance layer 15. The common electrode 17, the electrodes 19, and the connection electrodes 21 are formed of a material having conductivity, and are, for example, formed of one kind of metal among aluminum, gold, silver, and copper, or an alloy thereof with a thickness of 0.3 to 1.5 μm.

The common electrode 17 includes a main wiring portion 17*a*, two auxiliary wiring portions 17*b*, and a plurality of lead portions 17*c*. The main wiring portion 17*a* is commonly connected to the plurality of heat generation portions 9 and extends along one long side of the substrate 7. The auxiliary wiring portions 17*b* extend along one and the other short sides of the substrate 7, respectively. Each of the lead portions 17*c* extends towards each heat generation portion 9 from the main wiring portion 17*a*. The common electrode 17 is configured so that one end thereof is connected to the plurality of heat generation portions 9 and the other end thereof is connected to the FPC 5. Accordingly, the FPC 5 and each heat generation portion 9 are electrically connected to each other.

One ends of the plurality of individual electrodes 19 are connected to the heat generation portions 9, respectively, and the other ends thereof are connected to driving ICs 11. Accordingly, electrical connection between the respective heat generation portions 9 and the respective driving ICS 11 are established. The individual electrodes 19 divide the plurality of heat generation portions 9 into a plurality of groups, and electrically connect the heat generation portions 9 of each group to the driving IC 11 corresponding to each group.

One ends of the plurality of connection electrodes 21 are connected, to the driving ICs 11 and the other ends thereof are connected to the FPC 5, and accordingly, electrical connection between the respective driving ICs 11 and the FPC 5 is established. The plurality of connection electrodes 21 connected to each driving IC 11 are constituted by a plurality of wires having different functions.

As shown in FIG. 1, each driving IC 11 is disposed so as to correspond to each group of the plurality of heat generation portions 9. In addition, the driving IC 11 is electrically connected to the individual electrode 19 and the connection electrode 21. The driving IC 11 has a function of individually controlling an energization state of each heat generation portion 9. As the driving IC 11, a switching member including a plurality of switching elements therein may be used.

The electrical resistance layer 15, the common electrode 17, the individual electrodes 19, and the connection electrodes 21 described above are, for example, formed by sequentially laminating each material layer constituting each component on the heat storage layer 13, by sputtering, and processing the laminated body in a predetermined pattern using photo-etching. The common electrode 17, the individual electrodes 19, and the connection electrodes 21 can be formed in the same step at the same time.

As shown in FIGS. 1 and 2, the protection layer 25 which coats the heat generation portions 9, a part of the common electrode 17, and a part of the respective individual electrodes 19 is formed on the heat storage layer 13 disposed on the upper surface of the substrate 7. In FIG. 1, for convenience of description, a formation region of the protection layer 25 is shown with a dashed-dotted line and representation thereof is omitted.

The protection film 25 is configured to protect a region covering the heat generation portions 9, the common electrode 17, and the individual electrodes 19 from corrosion due to adhesion of moisture or the like contained in the atmosphere or abrasion due to contact with a recording medium to be printed.

As shown in FIGS. 1 and 2, a coating layer 27 which partially coats the electrical resistance layer 15, the common electrode 17, the individual electrodes 19, and the connection electrodes 21 is disposed on the heat storage layer 13. In FIG. 1, for convenience of description, a formation region of the coating layer 27 is shown with a dashed-dotted line. The coating layer 27 is configured to protect a region covering the coated common electrode 17, the individual electrodes 19, and the connection electrodes 21 from oxidation caused by contact with the atmosphere or corrosion due to adhesion of moisture or the like contained in the atmosphere.

As shown in FIG. 2, the coating layer 27 is preferably formed so as to overlap the end ox the protection layer 25, in order to more reliably protect the common electrode 17 and the individual electrodes 19. The coating layer 27, for example, can be formed of a resin material such as an epoxy resin or a polyimide resin using screen printing.

An opening portion (not shown) for exposing the individual electrodes 19 and the connection electrodes 21 connected to the driving ICs 11 is formed in the coating layer 27, and the individual electrodes 19 and the connection electrodes 21 exposed from the opening portion are electrically connected to the driving ICs 11. In addition, each, driving IC 11 is coated and sealed with a coating member 29 formed of a resin such as an epoxy resin or a silicone resin, in a state of being connected to the individual electrode 19 and the connection electrode 21.

The protection layer 25 will be described in detail with reference to FIG. 4.

The protection layer 25 constituting the thermal, head X1 includes a first protection layer 2, and a second protection layer 4 which is disposed on the first protection layer 2 and has a higher thermal conductivity than that of the first protection layer 2. A width $W_4$ of the second protection layer 4 is larger than a width $W_2$ of the first protection layer 2 when seen in an arrangement direction L1 of the heat generation portions 9 (hereinafter, also referred to as an "arrangement direction L1"). The first protection layer 2 and the second protection layer 4 are provided so as to extend in the arrangement direction L1.

The first protection layer 2 is disposed on the heat generation unit 9, the common electrode 17, and the individual electrodes 19 and has a function of reducing a level difference formed on the ends of the heat generation portions 9 through the common electrode 17 and the individual electrodes 19. Most of the first protection layer 2 is disposed on the heat generation portions 9 and a part of the first protection layer 2 is disposed on the common electrode 17 and the individual electrodes 19. That is, a part of the first protection layer 2 is provided so as to overlap with the common electrode 17 and the individual electrodes 19. In addition, the first protection layer 2 has a function of sealing the heat generation portions 9. By sealing the heat generation portions 9 with the first protection layer 2, it is possible to reduce a possibility of oxidation of the heat generation portions 9.

The first protection layer 2 is, for example, formed by applying a boron-based glass material, a bismuth-based glass material, or a bismuth borosilicate-based glass material by means of a thick film formation technology such as screen printing and firing the applied glass material. The thermal conductivity of the first protection layer 2 is preferably from 0.8 to 2 W/m·K and the thickness of the first protection layer 2 is preferably from 2 to 10 μm.

By forming the first protection layer 2 by means of a thick film formation technology such as screen printing, it is possible to reduce the possibility of failure of the step coverage due to a difference in the level between the heat generation portions 9, and the common electrode 17 and the individual electrodes 19. Accordingly, it is possible to improve sealing properties of the first protection layer 2.

In addition, as a glass material constituting the first protection layer 2, a crystallized glass material having a relatively low firing temperature may be used. In this case, it is possible to improve productivity of the thermal head X1 while maintaining oxidation resistance or the sealing properties.

A center of gravity $G_2$ of the first protection layer 2 is positioned on the heat generation portion 9. More specifically, the center of gravity $G_2$ of the first protection layer 2 is positioned on the center of the heat generation portion 9 in a sub-scanning direction. Accordingly, a heat spot of the heat generation portion 9 is positioned on the center of the heat generation portion 9 in the sub-scanning direction. Therefore, the thermal head X1 can perform uniform printing in the sub-scanning direction and can perform fine printing. The thermal head X1 shows particularly useful effects at a low printing speed equal to or lower than 1 inch/sec.

For the center of gravity $G_2$ of the first protection layer 2, the thermal head X1 is fractured, and a cross section of a plane orthogonal to the arrangement direction L1 is photographed. The photograph of the cross section is subjected to image processing, and it is possible to acquire the center of gravity $G_2$.

The second protection layer 4 is disposed on the first protection layer 2 and is formed of a material having a higher thermal conductivity than that of the first protection layer 2. The second protection layer 4 is disposed on the first protection layer 2, the common electrode 17, and the individual electrodes 19, and coats the first protection layer 2 and the common electrode 17. Accordingly, the width $W_4$ of the second protection layer 4 is larger than the width $W_2$ of the first protection layer 2 when seen in the arrangement direction L1.

The second protection layer 4 covers a part of the respective individual electrodes 19 on the respective heat generation portions 9 side and a region other than the individual electrodes 19 is coated with a coating layer (not shown). The second protection layer 4 disposed on the common electrode 17 and the individual electrodes 19 is disposed in a state of being in contact with the common electrode 17 and the individual electrodes 19. By coating an edge of the second protection layer 4 on the individual electrode 19 side with the coating layer 27, it is possible to improve sealing properties of the region of the thermal head X1 where the individual electrodes 19 are formed.

The second protection layer 4 is formed of a material such as SiC, SiON, SiN, or SiAlON and is provided by means of a thin film formation technology such as sputtering. The thermal conductivity of the second protection layer 4 is preferably from 8 to 40 W/m·K and the thickness of the second protection layer 4 is preferably from 2 to 10 μm. The second protection layer 4 is preferably formed over the entire region where the protection layer 25 is formed.

Since the second protection layer 4 is provided by means of a thin film formation technology such as sputtering, it is possible to make a film quality of the second protection layer 4 more uniform. Accordingly, it is possible to make the thermal conductivity of the second protection layer 4 more uniform. That is, the second protection layer 4 performs uniform thermal conduction of the excessive heat of the heat generation portions 9 to the common electrode 17 and the individual electrodes 19, and it is possible to improve heat radiation of the thermal head X1 and to perform printing with excellent dot reproducibility.

In addition, since the second protection layer 4 is provided by means of a thin film formation technology, an edge of the second protection layer 4 has a gently-sloping tapered shape. Accordingly, it is possible to reduce residual stress generated on the edge of the second protection layer 4 and to reduce the possibility of peeling of the second protection layer 4.

In the thermal head X1, the width $W_4$ of the second protection layer 4 is configured to be larger than the width $W_2$ of the first protection layer 2 when seen in the arrangement direction L1. Accordingly, it is possible to efficiently release the excessive heat which is generated by the heat generation portions 9 and is not contributed to the printing. That is, the second protection layer 4 having higher thermal conductivity and a larger width than the first protection layer 2 can efficiently diffuse the heat transferred to the first protection layer 2 and it is possible to reduce the amount of heat concentrated on the heat generation portions 9.

That is, the second protection layer 4 provided over the heat generation portions 9 can transfer the heat transferred to the first protection layer 2, to the second protection layer 4 on the common electrode 17 and the individual electrodes 19 and can diffuse the heat onto the common electrode 17 and the individual electrodes 19 from the second protection layer 4 disposed on the common electrode 17 and the individual electrodes 19.

In addition, since a part of the second protection layer 4 is disposed so as to be in contact with the common electrode 17 and the individual electrodes 19, it is possible to efficiently diffuse the excessive heat which is generated by the heat generation portions 9 and is not contributed to the printing, to the common electrode 17 and the individual electrodes 19.

Further, since the second protection layer 4 coats the entire surface of the first protection layer 2, it is possible to seal an edge 2*a* of the first protection layer 2 with the second protection layer 4 and it is possible to make hard to generation of sticking or dust of a recording medium. Since the thermal head X1 is configured so that a recording medium is not directly in contact with the first protection layer 2, it is not necessary for the first protection layer 2 to have abrasion resistance. Accordingly, the first protection layer 2 may only have sealing properties, and it is possible to improve the sealing properties and the abrasion resistance of the thermal head X1 with the different functions of the first protection layer 2 and the second protection layer 4.

Figure 4:
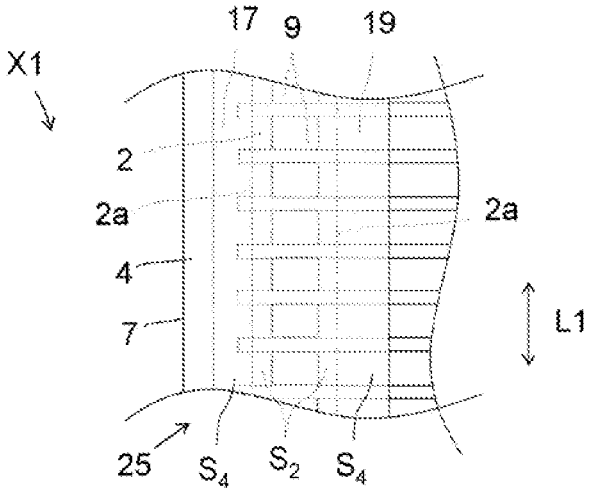
FIG. 4(*a*) is an enlarged plan view showing an extracted part of the thermal head shown in FIG. 1, and FIG. 4(*b*) is a cross-sectional view when FIG. 4(*a*) is seen in an arrangement direction of the heat generation portions.
Figure 4:
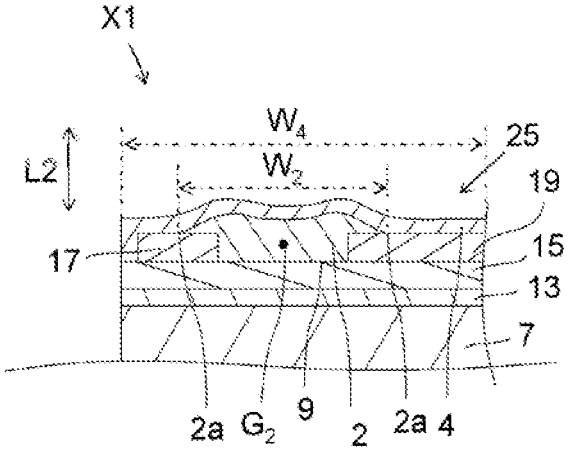

As shown in FIG. 4(*a*), in the thermal head X1, an area $S_4$ of a portion of the second protection layer 4 which portion lies on the common electrode 17 and the individual electrodes 19 (hereinafter, simply referred to as an area $S_4$) is larger than an area $S_2$ of a portion of the first protection layer 2 which portion lies on the common electrode 17 and the individual electrodes 19 (hereinafter, simply referred to as an area $S_2$) when seen in a plan view.

Accordingly, a contact area between the second protection layer 4, and the common electrode 17 and the individual electrodes 19 is larger than a contact area between the first protection layer 2, and the common electrode 17 and the individual electrodes 19. Therefore, the thermal head X1 can efficiently diffuse the heat transferred to the second protection layer 4 to the common electrode 17 and the individual electrodes 19.

In addition, since the first protection layer 2 is formed by means of a thick film formation technology and the second protection layer 4 is formed by means of a thin film formation technology, the density of the second protection layer 4 can be higher than the density of the first protection layer 2. Accordingly, it is possible to easily achieve a higher thermal conductivity of the second protection layer 4 than that of the first protection layer 2, it is possible to set the thickness of the second protection layer 4 to be smaller than that of the first protection layer 2, and it is possible to perform efficient heat diffusion with the excessive heat generated by the heat generation portions 9, by decreasing the printing efficiency of the thermal head X1.

Since the thickness of the first protection layer 2 is greater than the thickness of the second protection layer 4, a difference in the level between the heat generation portions 9, and the common electrode 17 and the individual electrodes 19 is hard to be generated on the surface of the protection layer 25. Accordingly, it is possible to realize excellent contact between the heat generation portions 9 and a recording medium. Therefore, it is possible to improve environmental resistance and abrasion resistance of the protection layer 25 and to suppress a decrease in printing efficiency accompanied with an increase in the thickness of the protection layer 25.

As a formation method of the second protection layer 4, sputtering has been exemplified, but the second protection layer 4 may be formed by means of CVD.

In addition, non-bias sputtering which does not apply a bias voltage to a sputtering target may be used. By forming the second protection layer 4 by means of non-bias sputtering, it is possible to decrease residual stress in the second protection layer 4 and to reduce the possibility of peeling of the second protection layer 4 from the first protection layer 2, the common electrode 17, and the individual electrodes 19. In particular, it is preferable to form the first protection layer 2 by means of a thick film formation technology and to form the second protection layer 4 by means of non-bias sputtering. Accordingly, it is possible to make adhesiveness of the first protection layer 2 and the second protection layer 4 favorable.

Next, a thermal printer Z1 will be described with reference to FIG. 5.

Figure 5:
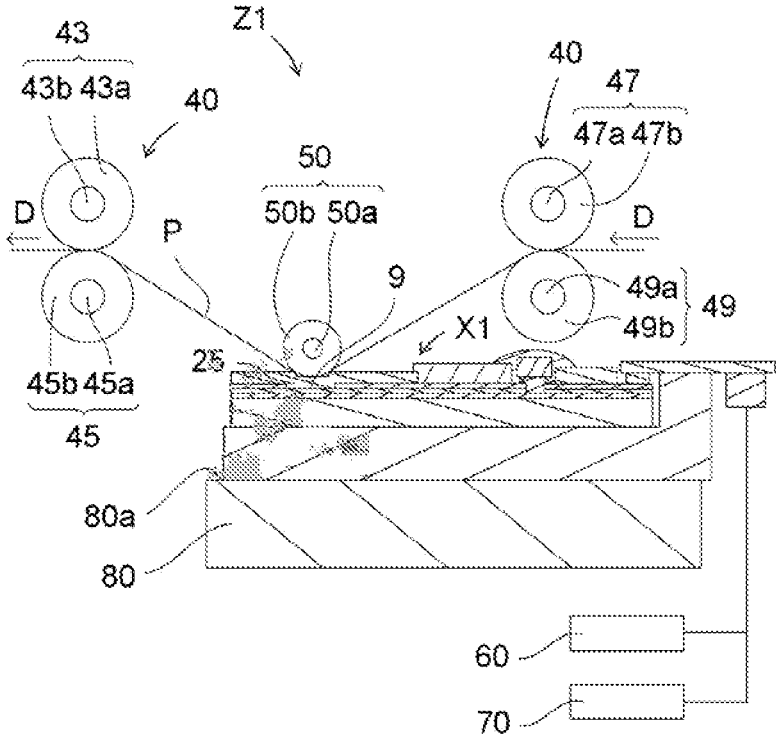
FIG. 5 is a schematic configuration diagram of a thermal printer according to one embodiment of the invention.

As shown in FIG. 5, the thermal printer Z1 of the embodiment includes the thermal head X1 described above, a conveyance mechanism 40, a platen roller 50, a power supply device 60, and a control device 70. The thermal head X1 is mounted on a mounting surface 80*a* of a mounting member 80 provided in a housing (not shown) of the thermal printer Z1. The thermal head X1 is mounted on the mounting member 80 so that the arrangement direction of the heat generation portions 9 is a main scanning direction which is a direction orthogonal to a conveyance direction S of the recording medium P which will be described later.

The conveyance mechanism 40 includes a driving portion (not shown) and conveying rollers 43, 45, 47, and 49. The conveyance mechanism 40 is configured to convey the recording medium P such as thermal paper or image receiving paper to which ink is transferred, onto the protection layer 25 lying on the plurality of heat generation portions 9 of the thermal head X1, in an arrow D direction of FIG. 5. The driving portion has a function of driving the conveying rollers 43, 45, 47, and 49 and a motor can be used to drive the rollers, for example. The conveying rollers 43, 45, 47, and 49, for example, can be configured by coating cylindrical shafts 43*a*, 45*a*, 47*a*, and 49*a* formed of metal such as stainless steel with elastic members 43*b*, 45*b*, 47*b*, and 49*b* formed of butadiene rubber. Although not shown, in a case where the recording medium P is the image receiving paper to which ink is transferred, the recording medium P and the ink film are conveyed between the recording medium P and the heat generation, portions 9 of the thermal head X1.

The platen roller 50 has a function of pressing the recording medium P against the protection layer 25 lying on the heat generation portions 9 of the thermal head X1. The platen roller 50 is disposed so as to extend in a direction orthogonal to the conveyance direction S of the recording medium P, and both ends of the platen roller 50 are supported so that the recording medium P can rotate in a state of being pressed against the heat generation portions 9. The platen roller 50, for example, can be configured by coating a cylindrical shaft 50*a* formed of metal such as stainless steel with elastic member 50*b* formed of butadiene, rubber.

The power supply device 60 has a function of supplying current for generating heat by the heat generation portions 9 of the thermal head X1 described above and current for operating the driving IC 11. The control device 70 has a function of supplying a control signal for controlling the operation of the driving IC 11, to the driving ICs 11, in order to achieve selective heat generation of the heat generation portions 9 of the thermal head X1 described above to.

As shown in FIG. 5, in the thermal printer Z1, the heat generation portions 9 selectively generate heat under the control of the power supply device 60 and the control device 70, while pressing the recording medium P against the heat generation portions 9 of the thermal head X1 with the platen roller 50 and conveying the recording medium P to the heat generation portions 9 with the conveyance mechanism 40, and accordingly, predetermined printing is performed on the recording medium P. In a case where the recording medium P is the image receiving paper or the like, ink of an ink film (not shown) conveyed by the recording medium P is transferred to the recording medium P, and accordingly, printing is performed on the recording medium.

Second Embodiment

Figure 6:
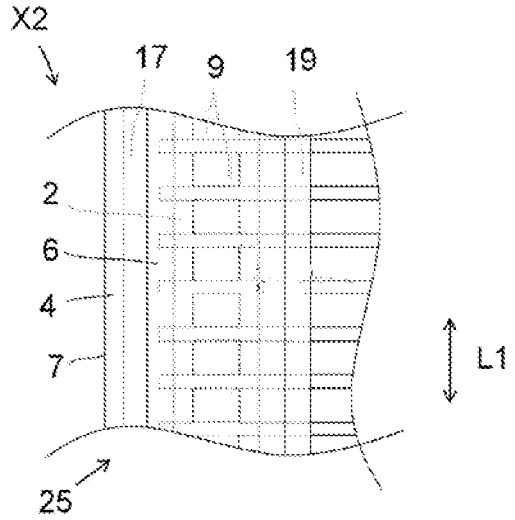
FIG. 6 shows a thermal head according to another embodiment of the invention, in which FIG. 6(*a*) is an enlarged plan view showing an extracted part of the thermal bead, and FIG. 6(*b*) is a cross-sectional view of FIG. 6(*a*) when seen in an arrangement direction of the heat generation portions.
Figure 6:
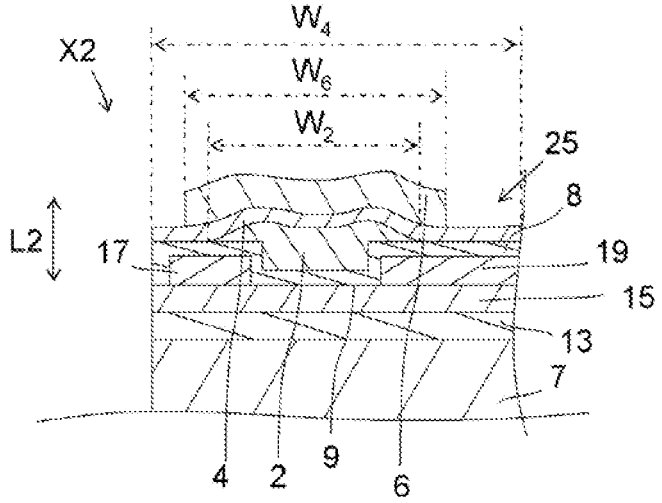

A thermal head X2 will be described with reference to FIG. 6.

The thermal head X2 further includes an antioxidant layer 8 and a third protection layer 6. The antioxidant layer 8 is disposed on the electrical resistance layer 15, the common electrode 17, and the individual electrodes 19. The third protection layer 6 is disposed on the second protection layer 4 and has a lower thermal conductivity than that of the second protection layer 4. The third protection layer 6 is provided so as to extend in the arrangement direction L1. The other configurations are the same as those of the thermal head X1 and therefore the description thereof will be omitted.

The antioxidant layer 8 is disposed on the electrical resistance layer 15, the common electrode 17, and the individual electrodes 19, and has a function of suppressing diffusion of oxygen atoms contained in the first protection layer 2 and the second protection layer 4 to the electrical resistance layer 15.

The antioxidant layer 8 is formed of a material such as SiC—SiO, SiN, SiCN, or SiAlON and is provided by means of a thin film formation technology such as sputtering. A thickness of the antioxidant layer 8 is preferably from 0.5 to 2 μm.

In this case, it is preferable to form the antioxidant layer 8 and the second protection layer 4 by non-bias sputtering and to form the first protection layer 2 by a thick film formation technology. Accordingly, it is possible to obtain favorable adhesiveness of the antioxidant layer 8, the first protection layer 2, and the second protection layer 4, and it is possible to improve, long-term, reliability of the protection layer 25.

Since the third protection, layer 6 is in contact with a recording medium (not shown), the third protection layer functions as an abrasion resistant layer. The third protection layer 6 is disposed on the second protection layer 4 and a width $W_6$ of the third protection layer 6 is smaller than the width $W_4$ of the second protection layer 4 when seen in a plan view. In addition, the width $W_6$ of the third protection layer 6 is larger than the width $W_2$ of the first protection layer 2 when seen in a plan view. Accordingly, the width $W_2$ of the first protection layer 2, the width $W_4$ of the second protection layer 4, and the width $W_6$ of the third protection layer 6 constituting the protection layer 25 satisfy a relationship of $W_2<W_6<W_4$.

The third protection layer 6 is, for example, formed by applying a boron-based glass material, a bismuth-based glass material, or a bismuth borosilicate-based glass material by a thick film formation technology such, as screen printing and firing the applied glass material. A thermal conductivity of the third protection layer 6 is preferably from 0.8 to 2 w/m·K and a thickness of the third protection layer 6 is preferably from 2 to 8 μm. Filler may be contained in order to improve abrasion resistance.

The thermal head X2 includes the third protection layer 6 which is disposed on the second protection layer 4 and has a lower thermal conductivity than that of the second protection layer 4. Accordingly, the second protection layer 4 is interposed between the first protection layer 2 and the third protection layer 6 having a lower thermal conductivity than that of the second protection layer 4. Therefore, the excessive heat generated in the vicinity of the heat generation unit 9 is easily transferred by the second protection layer 4 having a high thermal conductivity. As a result, the second protection layer 4 can easily release the heat transferred to the first protection layer 2, to the common electrode 17 and the individual electrodes 19 and can efficiently diffuse the heat by the second protection layer 4.

By forming the first protection layer 2 and the third protection layer 6 by means of a thick film formation technology, it is possible to make the action with respect to external stress of the first protection layer 2 and the third protection layer 6 disposed on and blow the second protection layer 4 similar to each other. Accordingly, it is possible to decrease stress strain applied to the second protection layer 4, and it is possible to reduce occurrence of peeling on the second protection layer 4.

The width $W_6$ of the third protection layer 6 is larger than the width $W_2$ of the first protection layer 2 when seen in the arrangement direction of the heat generation portions 9. Accordingly, it is possible to coat the edge of the first protection layer 2 by the third protection layer 6 through the second protection layer 4, it is possible to alleviate mechanical stress of the edge of the first protection layer 2 due to platen pressure when printing, and it is possible to improve the sealing properties of the entire protection layer 25.

In addition, the width $W_6$ of the third protection layer 6 is smaller than the width $W_4$ of the second protection layer 4 when seen in the arrangement direction of the beat generation portions 9. Accordingly, the third protection layer 6 is only disposed on the second protection layer 4.

Herein, the common electrode 17 or the individual electrodes 19 are patterned and disposed on the substrate 7 or the heat storage layer 13. The pattern of the common electrode 17 or the individual electrodes 19 has a constant thickness, and unevenness is generated by a region where the pattern of the common electrode 17 or the individual electrodes 19 is formed and a region where the pattern of the common electrode 17 or the individual electrodes 19 is not formed.

Accordingly, in a case where the third protection layer 6 is extended to the upper portion of the substrate 7, the heat storage layer 13, the common electrode 17, or the individual electrodes 19, unevenness may be generated to the surface including the edge of the third protection layer 6 (surface being in contact with the recording medium) by the thickness of the pattern of the common electrode 17 or the individual electrodes 19. Therefore, the third protection layer 6 and the recording medium may be in contact with each other in an uneven manner.

However, the third protection layer 6 is disposed on the second protection layer 4 having a flat surface, and it is possible to reduce a possibility of generation of the unevenness on the surface of the third protection layer 6 being in contact with the recording medium. Therefore, it is possible to make the contact state of the third protection layer 6 and the recording medium more uniform. Accordingly, it is possible to reduce a possibility of generation of paper scratch on the recording medium, adhesion of dust of the recording medium, or generation of wrinkles on the recording medium.

The first protection layer 2, the second protection layer 4, and the third protection layer 6 preferably contain oxygen atoms, respectively. An amount of oxygen atoms contained in a boundary region of the second protection layer 4 with the first protection layer 2 and a boundary region of the second protection layer 4 with the third protection layer 6 is preferably greater than an amount of oxygen atoms contained in a region other than the boundary region of the second protection layer 4.

With such a configuration, it is possible to increase adhesiveness of the boundary between the first protection layer 2 and the second protection layer 4 formed of different materials. It is possible to increase adhesiveness of the boundary between the second protection layer 4 and the third protection layer 6 formed of different materials. In other words, when seen in a thickness direction L2 of the second protection layer 4 (hereinafter, referred to as a thickness direction L2), the content of the oxygen atoms contained in the second protection layer 4 is gradually decreased and reaches a minimum value in the center of the second protection layer in the thickness direction L2, and is gradually increased.

The configuration described above can be manufactured by the following method, for example. In the case of forming the second protection layer 4 by means of sputtering, an atmosphere for sputtering a sample may be set as an oxygen atmosphere, and an oxygen concentration in an initial period and a final period of forming the second protection layer 4 may be increased.

The content of the oxygen atoms in the boundary region of the second protection layer 4 with the first protection layer 2 is preferably from 6 to 12% by atoms, the content of the oxygen atoms in the boundary region of the second protection layer 4 with the third protection layer 6 is preferably from 17 to 26% by atoms, and the content of the oxygen atoms in the center of the second protection layer 4 in the thickness direction L2 is preferably equal to or smaller than 5% by atoms.

The mapping of a constituent element is prepared using an electron microprobe (EPMA), and the boundary region of the second protection layer 4 with the first protection layer 2 can be a region from a boundary to a position within 0.4 μm to the second protection layer 4 side, by defining the position where the constituent element changes as the boundary, in the mapping prepared by the EPMA. This is the same as in the case of the boundary region of the second protection layer 4 with the third protection layer 6. The content of the oxygen atoms contained in the second protection layer 4 can be measured using an X-ray photoelectron spectrometer (XPS).

A hardness D2 of the first protection layer 2, a hardness D4 of the second protection layer 4, and a hardness D6 of the third protection layer 6 preferably satisfy a relationship of D4>D2>D6. Accordingly, it is possible to improve abrasion resistance, sealing properties, and sliding properties of the thermal head X2. The hardness of each protection layer is Vickers' hardness.

An example in which the first protection layer 2, the second protection layer 4, and the third protection layer 6 contain the oxygen atoms has been described, but the other configurations may be used. For example, the first protection layer 2 and the second protection layer 4 adjacent to each other may contain the oxygen atoms, and an amount of the oxygen atoms contained in a boundary region of the second protection layer 4 with the first protection layer 2 may be larger than the amount of the oxygen contained in a region other than the boundary region of the second protection layer 4. Accordingly, it is possible to improve the adhesiveness between the first protection layer 2 and the second protection layer. This also applies to the case where the second protection layer 4 and the third protection layer contain the oxygen atoms, in the same manner.

Third Embodiment

Figure 7:
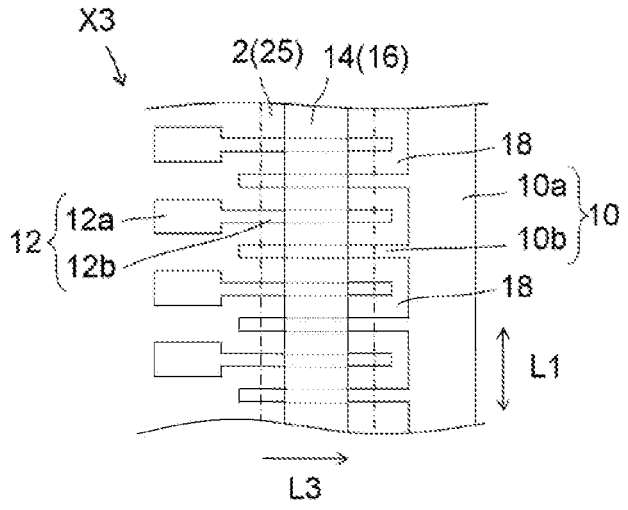
FIG. 7 shows a thermal head according to still another embodiment of the invention, in which FIG. 7(*a*) is an enlarged plan view showing an extracted part of the thermal head, and FIG. 7(*b*) is a cross-sectional view of FIG. 7(*a*) when seen in an arrangement direction of the heat generation portions.
Figure 7:
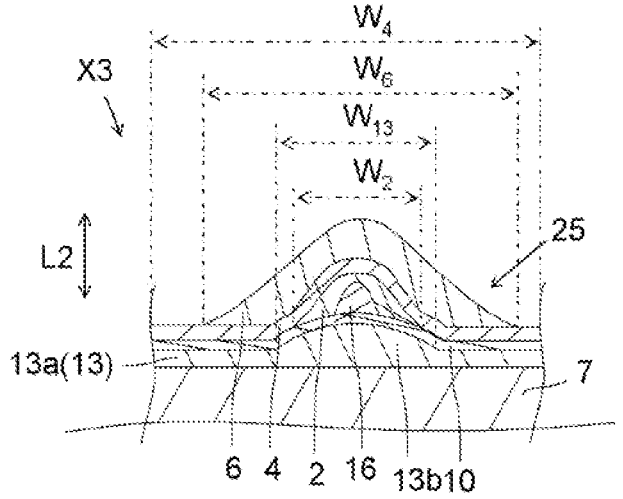

A thermal head X3 according to a third embodiment will be described with reference to FIG. 7. In FIG. 7(*a*), representation of the protection layers other than the first protection layer 2 among the protection layer 25 will be omitted. The first protection layer 2 is shown with a dashed-dotted line. In the thermal head X3, the configurations of a common electrode 10, individual electrodes 12, the heat storage layer 13, a heat-generating resistor 14, and heat generation portions 16 are different from those of the thermal, head X1.

The heat storage layer 13 includes a ground portion 13*a* and a swollen portion 13*b*. The ground portion 13*a* is formed approximately over the entire surface of the substrate 7 and has approximately the same thickness. The swollen portion 13*b* is disposed below the heat generation portion 9 and has a stripe shape extending in the arrangement direction L1, and a shape of the cross section has a semicircular shape.

In the thermal head X3, it is possible to successfully press the recording medium against the protection layer 25 formed on the heat generation portion 9, by providing the swollen portion 13*b*. A width, of the swollen portion 13*b* is preferably from 0.6 to 1.5 mm and a height thereof is preferably from 50 to 100 μm.

The common electrode 10 includes a main wiring portion 10*a* and a lead portion 10*b*. The main wiring portion 10*a* is provided to extend in the arrangement direction L1. The lead portion 10*b* is drawn in a direction approximately orthogonal to the arrangement direction L1 from the main wiring portion 10*a* and has a comb shape at predetermined intervals in the arrangement direction L1 towards the heat-generating resistor 14. Accordingly, a level difference 18 is formed in a connecting portion between the main wiring portion 10*a* and the lead portion 10*b*.

The plurality of individual electrodes 12 each have a pad portion 12*a* and a lead portion 12*b*. The pad portion 12*a* is a portion electrically connected to the driving IC (not shown). The lead portion 12*b* is drawn in a direction approximately orthogonal to the arrangement direction L1 from the 12*a* and is provided at predetermined intervals in the arrangement direction L1 towards the heat-generating resistor 14.

The lead portion 12*b* of the individual electrode 12 is disposed so as to extend between the lead portions 10*b* of the common electrode 10. Accordingly, when seen in a plan view, the lead portion 12*b* of the individual electrode 12 and the lead portions 10*b* of the common electrode 10 are alternately disposed in the arrangement direction L1. The common electrode 10 and the individual electrode 12 can be formed of a material such as Au, Al, or Ni, for example.

The lead portion 12*b* of the individual electrode 12 and the lead portions 10*b* of the common electrode 10 are drawn to an upper portion of the swollen portion 13*b*, and the heat-generating resistor 14 is disposed thereon. The heat-generating resistor 14 is disposed to extend in the arrangement direction L1 and is disposed over the lead portions 10*b* of the common electrode 10 and the lead portions 12*b* of the individual electrodes 12. Accordingly, the heat-generating resistor 14 is disposed on the swollen portion 13*b*.

The lead portion 10*b* of the common electrode 10 and the lead portion 12*b* of the individual electrode 12 which are adjacent to each other are electrically connected to each other, and the heat-generating resistor 14 disposed between the lead portion 10*b* of the common electrode 10 and the lead portion 12*b* of the individual electrode 12 which are adjacent to each other functions as the heat generation portion 16. As the heat-generating resistor 14, ruthenium oxide can be used, for example.

In the thermal head X3, the first protection layer 2 is disposed on the heat generation portions 16, a part of the common electrode 10, and a part of the respective individual electrodes 12. The width $W_2$ of the first protection layer 2 is smaller than a width $W_{13}$ of the heat storage layer 13. In addition, the edge 2*a* of the first protection layer 2 on the common electrode 10 side is disposed on the lead portion 10*a* of the common electrode 10 when seen in the arrangement direction L1. Accordingly, the first protection layer 2 is disposed on the heat-generating resistor 14 side with respect to the level difference 18.

The second protection layer 4 is disposed so as to cover the first protection layer 2, a part of the common electrode 10, and a part of the respective individual electrodes 12. The width $W_4$ of the second protection layer 4 is larger than the width $W_2$ of the first protection layer 2 and is nearly equal to the width of the protection layer 25.

The third protection layer 6 is disposed so as to cover the second protection layer 4. The width $W_6$ of the third protection layer 6 is larger than the width $W_2$ of the first protection layer 2 and is smaller than the $W_4$ of the second protection layer 4.

In addition, in the first protection layer 2, a thickness of a portion of the first protection layer 2 in the thickness direction L2 which portion lies above the heat generation portions 16 is larger than a thickness of a region other than the portion of the first protection layer 2 in the thickness direction L2. Accordingly, it is possible to shorten a distance between the heat generation portions 16 and the second protection layer 4, and it is possible to efficiently diffuse the excessive heat generated by the heat generation portions 16 to the second protection layer 4.

Furthermore, the edge 2*a* of the first protection layer 2 is positioned on the lead portion 10*a* of the common electrode 10, and the first protection layer 2 is not disposed above the level difference 18. Accordingly, a recording medium (not shown) passing on the protection layer 25 is conveyed in a state of being lifted upwards by the protection layer 25, and is conveyed above the level difference 18 without being in contact with a level difference of the second protection layer 4 formed corresponding thereto by the level difference 18. Therefore, it is possible to reduce a possibility of accumulation of dust of a recording medium generated by the recording medium on the protection layer 25 disposed above the level difference 18.

Since the width $W_4$ of the second protection layer 4 is larger than the width $W_{13}$ of the heat storage layer 13, it is possible to effectively diffuse the excessive heat generated by the heat generation portions 9, without decreasing the effect of the thermal transfer to the recording medium due to a convex swollen portion 13*b*, and it is possible to reduce heat concentration of the heat generation portions 9.

An example in which the third protection layer 6 is formed, has been described, but the third protection layer 6 may not necessarily be formed.

Fourth Embodiment

Figure 8:
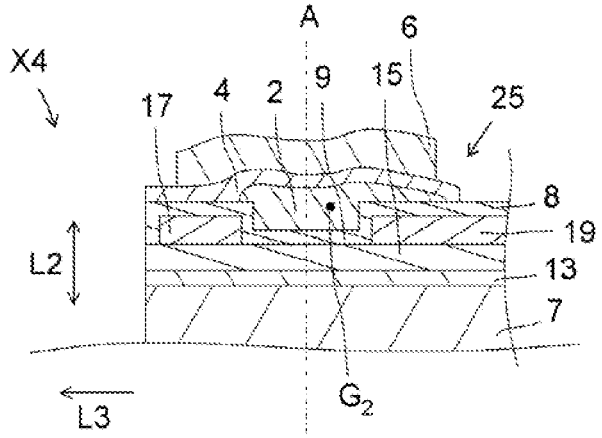
FIG. 8 is a cross-sectional view of a thermal head according to still another embodiment when seen in an arrangement direction of the heat generation portions.

A thermal head X4 according to a fourth embodiment will be described with reference to FIG. 8. The thermal head X4 has a configuration in which the center of gravity $G_2$ of the first protection layer 2 is disposed to be deviated to an upstream side in a conveyance direction L3 of a recording medium (not shown) (hereinafter, referred to as a conveyance direction L3), from an imaginary line A passing the center of the heat generation portion 9 along the thickness direction L2. In other words, the center of gravity $G_2$ of the first protection layer 2 is disposed on the individual electrode 19 side with respect to the center of the heat generation portion 9.

Accordingly, a height of a portion positioned on the upstream side in the conveyance direction L3 with respect to the heat generation portion 9 is higher than a height of a portion positioned on a downstream side in the conveyance direction L3 with respect the heat generation portion 9, and a contact pressure against the recording medium increases. This is more significant in a case of a high printing speed equal, to or higher than 2 inches/sec.

A temperature of a portion positioned on the upstream side in the conveyance direction L3 with respect to the heat generation portion 9 is higher than a temperature of a portion positioned on the downstream side in the conveyance direction L3 with respect to the heat generation portion 9, by the first protection layer 2 having a small thermal conductivity.

Accordingly, it is possible to efficiently heat the recording medium and to improve thermal, efficiency of the thermal head X4.

For the center of gravity $G_2$ of the first protection layer 2, the thermal head X4 is fractured and a cross section of a surface orthogonal to the arrangement direction L1 is photographed. The photograph of the cross section is subjected to image processing, and it is possible to acquire the center of gravity $G_2$.

Fifth Embodiment

Figure 9:
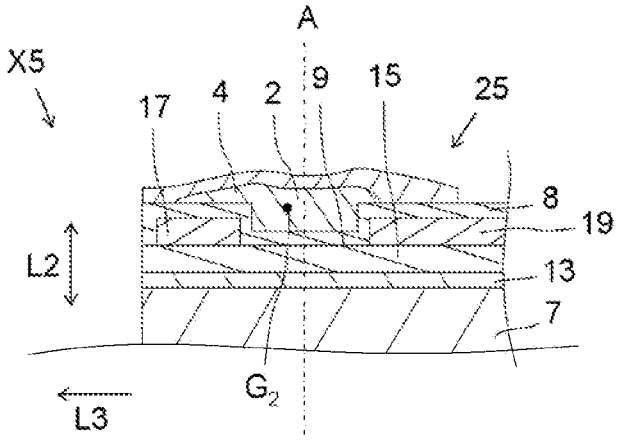
FIG. 9 is a cross-sectional view of a thermal head according to still another embodiment of the invention when seen in an arrangement direction of the heat generation portions.

A thermal head X5 according to a fifth embodiment will be described with reference to FIG. 9. The thermal head X5 has a configuration in which the center of gravity $G_2$ of the first protection layer 2 is disposed to be deviated to the downstream side in the conveyance direction L3 of a recording medium (not shown), from the imaginary line A passing the center of the heat generation portion 9 along the thickness direction L2. In other words, the center of gravity $G_2$ of the first protection layer 2 is disposed on the common electrode 17 side with respect to the center of the heat generation portion 9.

Herein, in the thermal head X5, sliding properties between the recording medium and the protection layer 25 or peeling properties between the recording medium and the protection layer 25 may be different depending on the recording medium to be printed. Accordingly, in a case where the printing is performed by the same thermal head X5, a certain recording medium shows excellent sliding properties and peeling properties. However, in the different recording medium, the dust of a recording medium may be adhered to the downstream side in the conveyance direction L3. As a cause of the adhesion of the dust of the recording medium, it is considered that a temperature of the protection layer 25 positioned on the downstream side in the conveyance direction L3 is low and a friction force between the recording medium and the protection layer 25 is increased on the downstream side in the conveyance direction L3.

With respect to this, in the thermal head X5, the center of gravity $G_2$ of the first protection layer 2 is disposed to be deviated to the downstream side in the conveyance direction L3, from the imaginary line A passing the center of the heat generation unit 9 along the thickness direction L2. In other words, the center of gravity $G_2$ of the first protection layer 2 is disposed on the common electrode 17 side with respect to the center of the heat generation portion 9. Accordingly, it is possible to increase the temperature of the protection layer 25 positioned on the downstream side in the conveyance direction L3.

Therefore, it is possible to reduce rapid cooling of the recording medium, and it is possible to reduce a possibility of adhesion of the dust of the recording medium on the downstream side in the conveyance direction L3 or a possibility of generation of sticking.

In particular, since the center of gravity $G_2$ of the first protection layer 2 having low thermal conductivity is disposed to be deviated to the downstream side in the conveyance direction L3, it is possible to increase the temperature of the downstream side of the protection layer 25 in the conveyance direction L3 by the heat stored in the first protection layer 2.

In order to decrease the temperature of the upstream side in the conveyance direction L3, a method of decreasing the diffusion of heat due to heat transfer of the second protection layer 4 may be adopted. Specifically, a center of gravity of the second protection layer 4 (not shown) may be moved to the upstream side in the conveyance direction L3.

With such a configuration, it is possible to efficiently diffuse the heat on the upstream side in the conveyance direction L3 to the common electrode 17 by the second protection layer 4, it is possible to relatively increase the temperature of the upstream side in the conveyance direction L3 by decreasing the heat on the upstream side in the conveyance direction L3, and it is possible to reduce a possibility of adhesion of dust of the recording medium on the upstream side in the conveyance direction L3.

Sixth Embodiment

Figure 10:
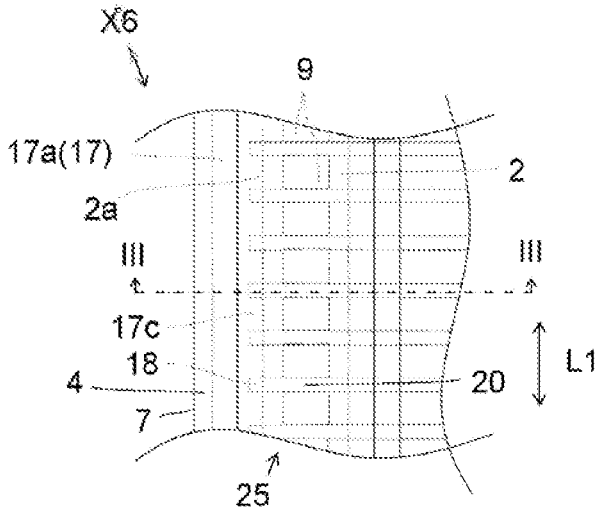
FIG. 10 shows a thermal head according to still another embodiment of the invention, in which FIG. 10(*a*) is an enlarged plan view showing an extracted part of the thermal head, and FIG. 10(*b*) is a cross-sectional view taken along the line III-III shown in FIG. 10(*a*)
Figure 10:
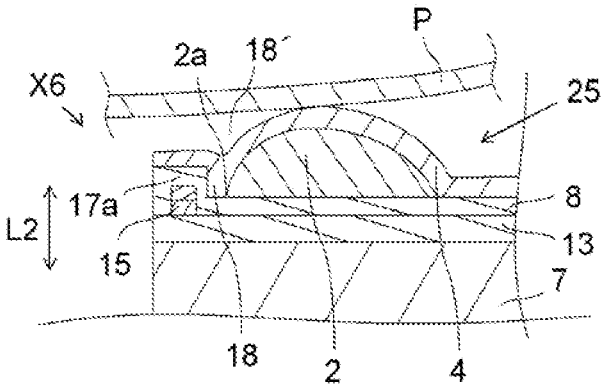

A thermal head X6 according to a sixth embodiment will be described with reference to FIGS. 10(*a*) and 10(*b*). In the thermal head X6, the edge 2*a* of the first protection layer 2 is disposed between the main wiring portion 17*a* of the common electrode 17 and the heat generation portion 9 when seen in the arrangement direction L1. The thermal head X6 has a configuration in which the level difference 18 is formed in a connecting portion between the main wiring portion 17*a* and the lead portion 17*c*. Accordingly, the first protection layer 2 is disposed on the heat generation portion 9 side with, respect to the level difference 18.

In the vicinity of the edge 2*a* of the first protection layer 2, a height of the first protection layer 2 from the substrate 7 is rapidly decreased towards the edge 2*a*, and accordingly the height of the protection layer 25 from the substrate 7 is also decreased. In addition, the edge 2*a* of the first protection layer 2 is disposed between the main wiring portion 17*a* and the heat generation portion 9, and the first protection layer 2 is not formed on the main wiring portion 17*a*.

Accordingly, on the surface of the protection layer 25, a level difference 18' is formed, between an upper portion of the main wiring portion 17*a*, and an upper portion of the heat generation portion 9 and an upper portion of a region 20 adjacent to the heat generation portion 9. Since the level difference 18' is formed on the surface of the protection layer 25, the recording medium P and the protection layer 25 is partially separated from each other. Therefore, in the thermal head X6, the protection layer 25 and the recording medium P do not continuously come in contact with each other, and it is possible to reduce a possibility of generation of sticking.

Seventh Embodiment

Figure 11:
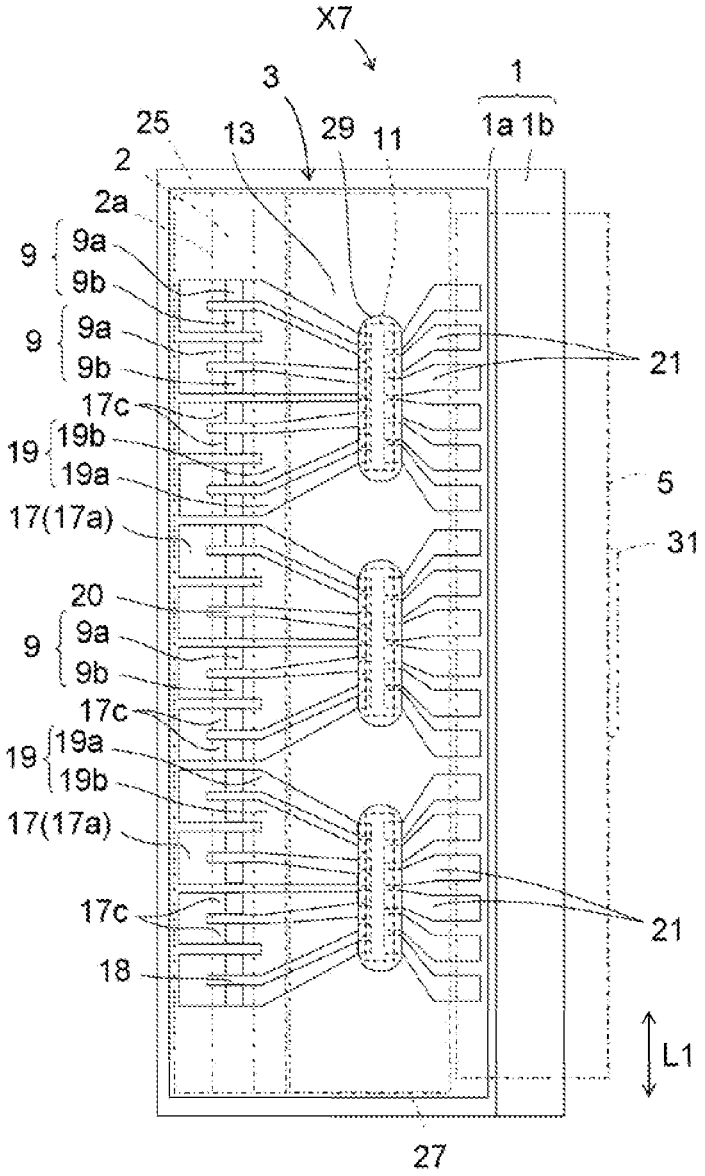
FIG. 11 is a plan view showing a thermal head according to still another embodiment of the invention.

A thermal head X7 according to a seventh embodiment will be described with reference to FIG. 11. The thermal head X7 has configurations of the common electrode 17 and the individual electrode 19 different from those of the thermal head X6, and the other configurations thereof are the same.

The plurality of heat generation portions 9 each constitute a first heat generation portion 9*a* and a second heat generation portion 9*b* which are a pair of heat generation portions. The first heat generation portion 9*a* and the second heat generation portion 9*b* are electrically connected to each other by the common electrode 17. The first heat generation portion 9*a* and the driving IC 11 are electrically connected to each other by an individual electrode 19*a*. In addition, the second heat generation portion 9*b* and the driving IC 11 are electrically connected to each other by an individual electrode 19*b*.

The plurality of common electrodes 17 are disposed in the arrangement direction L1 and each include the main wiring portion 17*a* and the lead portion 17*c*. The main wiring portion 17*a* is formed to be long in the arrangement direction L1. The lead portion 17*c* is provided so as to extend from the main wiring portion 17*a* to the heat generation portion 9. The level difference 18 is formed in the vicinity of the connecting portion between the main wiring portion 17*a* and the lead portion 17*c*.

The individual electrode 19*a* electrically connects the first heat generation portion 9*a* and the driving IC 11. The individual electrode 19*b* electrically connects the second heat generation portion 9*b* and the first heat generation portion 9*a* adjacent to each other.

Even in the thermal head X7, the edge 2*a* of the first protection layer 2 is disposed between the main wiring portion 17*a* of the common electrode 17 and the heat, generation portion 9 when seen in the arrangement direction L1. Accordingly, on the surface of the protection layer 25, a level difference (not shown) may be formed between the upper portion of the main wiring portion 17*a*, and the upper portion of the heat generation portion 9 and an upper portion of a region 20 adjacent to the heat generation portion 9. Since the level difference is formed on the surface of the protection layer 25, the recording medium P and the protection layer 25 is partially separated from each other. Therefore, in the thermal head X7, the protection layer 25 and the recording medium P do not continuously come in contact with each other, and it is possible to reduce a possibility of generation of sticking.

Hereinabove, one embodiment of the invention has been described, but the invention is not limited to the embodiment described above, and various modifications are possible without departing from the scope of the invention. Fore example, the thermal printer Z1 using the thermal bead X1 of the first embodiment has been described, but there is no limitation thereto, and the thermal heads X2 to X7 may be used in the thermal printer Z1. In addition, the thermal heads X1 to X7 of the plurality of embodiments may be combined with each other.

an example using the FPC 5 in the electrical connection between the thermal heads X1 to X7 and the outside has been described, but there is no limitation thereto. For example, even when the connector 31 is directly mounted on the thermal heads X1 to X7, the same effects can be realized. In addition, even with an edge head in which the heat generation portion 9 is formed on an edge surface of the substrate 7, the same effects can be achieved.

REFERENCE SIGNS LIST

X1-X7: Thermal head
Z1: Thermal printer
1: Radiator
2: First protection layer
3: Head base body
4: Second protection layer
5; Flexible printed circuit
6: Third protection layer
7: Substrate
8: Antioxidant layer
9: Heat generation portion
10: Common electrode
11: Driving IC
12: Individual electrode
13: Heat storage layer
14: Heat-generating resistor
15: Electrical resistance layer
17: Common electrode
19: Individual electrode
21: IC-FPC connection electrode
23: Jointing material
25: Protection layer
27: Coating layer
29: Coating member

The invention claimed is:

1. A thermal head, comprising:
a substrate;
a plurality of heat generation portions which are disposed aligned on the substrate;
electrodes which are electrically connected to the heat generation portions; and
a protection layer which coats the heat generation portions and a part of the respective electrodes,
the protection layer including:
a first protection layer which is disposed on the heat generation portions; and
a second protection layer which is disposed on the first protection layer and has a higher thermal conductivity than that of the first protection layer, wherein
a width of the second protection layer is larger than that of the first protection layer when seen in an arrangement direction of the heat generation portions,
the first protection layer is in contact with the electrodes, and the second protection layer is in contact with the electrodes, and
lengths of interfaces between the second protection layer and the electrodes are larger than lengths of interfaces between the first protection layer and the electrodes when seen in a cross-sectional view of the thermal head.

2. The thermal head according to claim 1,
wherein the second protection layer coats an entirety of the first protection layer.

3. The thermal head according to claim 1,
wherein an area of a portion of the second protection layer which portion lies on the electrode is larger than that of a portion of the first protection layer which portion lies on the electrode when seen in a plan view.

4. The thermal head according to claim 1,
wherein a thickness of the first protection layer is larger than that of the second protection layer.

5. The thermal head according to claim 1,
wherein the electrodes are composed of a common electrode which is commonly connected to the plurality of heat generation portions and individual electrodes which are individually connected to the plurality of heat generation portions,
the common electrode includes a main wiring portion extending in the arrangement direction of the heat generation portions, and lead portions for electrically connecting the main wiring portion and the heat generation portions, and
an edge of the first protection layer is disposed between the main wiring portion and the heat generation portions when seen in the arrangement direction of the heat generation portions.

6. The thermal head according to claim 5,
wherein a center of gravity of the first protection layer is disposed on a side of the individual electrodes with respect to a center of each of the heat generation portions when seen in the arrangement direction of the heat generation portions.

7. The thermal head according to claim 5,
wherein a center of gravity of the first protection layer is disposed on a side of the common electrode with respect to a center of each of the heat generation portions when seen in the arrangement direction of the heat generation portions.

8. The thermal head according to claim 1, further comprising:

a third protection layer which is disposed on the second protection layer and has a lower thermal conductivity than that of the second protection layer.

9. The thermal head according to claim 8, wherein a width of the third protection layer is larger than that of the first protection layer when seen in the arrangement direction of the heat generation portions.

10. The thermal head according to claim 8, wherein a width of the third protection layer is smaller than that of the second protection layer when seen in the arrangement direction of the heat generation portions.

11. The thermal head according to claim 8, wherein the second protection layer and the third protection layer contain oxygen atoms, and an amount of oxygen atoms contained in a boundary region of the second protection layer with the third protection layer is larger than that of oxygen atoms contained in a region other than the boundary region of the second protection layer.

12. A thermal printer, comprising:

the thermal head according to claim 1;

a conveyance mechanism of conveying a recording medium onto the heat generation portions; and a platen roller which presses the recording medium against the heat generation portions.

13. The thermal head according to claim 1, wherein a contact area between the second protection layer and the electrodes is larger than a contact area between the first protection layer and the electrodes.

14. The thermal head according to claim 1, wherein a density of the second protection layer is higher than a density of the first protection layer.

15. The thermal head according to claim 1, wherein a hardness of the second protection layer is larger than a hardness of the first protection layer.

16. A thermal head, comprising:

a substrate;

a plurality of heat generation portions which are disposed aligned on the substrate;

electrodes which are electrically connected to the heat generation portions; and a protection layer which coats the heat generation portions and a part of the respective electrodes, the protection layer including:

a first protection layer which is disposed on the heat generation portions;

a second protection layer which is disposed on the first protection layer and has a higher thermal conductivity than that of the first protection layer; and a third protection layer which is disposed on the second protection layer and has a lower thermal conductivity than that of the second protection layer, wherein a width of the second protection layer being is larger than that of the first protection layer when seen in an arrangement direction of the heat generation portions, and a width of the third protection layer is smaller than that of the second protection layer when seen in the arrangement direction of the heat generation portions.

17. The thermal head according to claim 16, wherein a density of the second protection layer is higher than a density of the first protection layer.

18. The thermal head according to claim 16, wherein a hardness of the second protection layer is larger than a hardness of the first protection layer, and the hardness of the first protection layer is larger than a hardness of the third protection layer.

19. A thermal head, comprising:

a substrate;

a plurality of heat generation portions which are disposed aligned on the substrate;

electrodes which are electrically connected to the heat generation portions; and a protection layer which coats the heat generation portions and a part of the respective electrodes, the protection layer including:

a first protection layer which is disposed on the heat generation portions;

a second protection layer which is disposed on the first protection layer and has a higher thermal conductivity than that of the first protection layer; and a third protection layer which is disposed on the second protection layer and has a lower thermal conductivity than that of the second protection layer, wherein a width of the second protection layer being is larger than that of the first protection layer when seen in an arrangement direction of the heat generation portions, and the second protection layer and the third protection layer contain oxygen atoms, and an amount of oxygen atoms contained in a boundary region of the second protection layer with the third protection layer is larger than that of oxygen atoms contained in a region other than the boundary region of the second protection layer.

20. The thermal head according to claim 19, wherein a hardness of the second protection layer is larger than a hardness of the first protection layer, and the hardness of the first protection layer is larger than a hardness of the third protection layer.

* * * * *